US006095498A

United States Patent [19]

Lemoine

[11] Patent Number: 6,095,498

[45] Date of Patent: Aug. 1, 2000

[54] DEVICE FOR PULLING OBJECTS

[76] Inventor: James R. Lemoine, P.O. Box 302, Simmesport, La. 71369

[21] Appl. No.: 09/130,912

[22] Filed: Aug. 7, 1998

[51] Int. Cl.[7] ..... E21B 19/00

[52] U.S. Cl. ..... 254/30

[58] Field of Search ..... 92/248, 249; 254/93 R, 254/93 H, 30, 29 R

[56] References Cited

U.S. PATENT DOCUMENTS

| | | | |
|---|---|---|---|
| 2,080,673 | 5/1937 | Roemer | 254/30 |
| 2,735,649 | 2/1956 | Swallert | 254/18 |
| 2,823,065 | 2/1958 | Henry | 254/30 |
| 2,967,044 | 1/1961 | Corcreham et al. | 254/30 |
| 3,563,319 | 2/1971 | Nixon . | |
| 3,950,837 | 4/1976 | D'Antoni, Sr. . | |
| 4,016,960 | 4/1977 | Wilcox | 62/165 PR |
| 4,187,708 | 2/1980 | Champoux . | |
| 4,256,286 | 3/1981 | Hudgins . | |
| 4,422,621 | 12/1983 | Ekern . | |
| 4,671,493 | 6/1987 | Ravencroft . | |
| 4,706,935 | 11/1987 | Thompson . | |
| 4,804,165 | 2/1989 | Pippin et al. . | |
| 4,846,445 | 7/1989 | Pfeffer . | |
| 4,925,159 | 5/1990 | Younes . | |
| 5,253,844 | 10/1993 | Cotic et al. . | |
| 5,566,924 | 10/1996 | Shirk . | |
| 5,597,151 | 1/1997 | Duncan . | |

*Primary Examiner*—Robert C. Watson
*Attorney, Agent, or Firm*—Sieberth & Patty, L.L.C.

[57] ABSTRACT

A device which comprises (a) at least one receiving means for receiving a free end portion of an elongate first object, the elongate first object being comprised of (i) the free end portion and (ii) an embedded end portion which is embedded in a second object, (b) at least one clamping means connected to or integral with the receiving means for applying at least one clamping force to the free end portion of the elongate first object, and (c) at least one jack which comprises a cylinder, a piston, a piston rod, and a base, the jack being connected to the receiving means so that when (i) the elongate first object is received by the receiving means, (ii) the base is in contact with the second object and (iii) a pressurized fluid is introduced into the jack to provide a separating force, the receiving means may be urged away from the second object while the clamping means applies the clamping force to the elongate first object, the amount of clamping force applied by the clamping means being proportional to the magnitude of the separating force. Other devices and methods are also described which enable the efficient removal of elongate objects such as, e.g., wooden stakes, from other objects such as, for example, the ground in which the elongate objects are embedded.

20 Claims, 5 Drawing Sheets

DEVICE FOR PULLING OBJECTS

TECHNICAL FIELD

The present invention relates to devices and methods for pulling elongate objects such as, e.g., stakes, pins, spikes, etc., from another object.

BACKGROUND

Numerous devices are know for removing stakes and other elongate objects which have been driven into another object such as, for example, the ground. Stakes, for example, are common at construction sites where forms for pouring concrete foundations, curbs, gutters, and the like are constructed using wooden boards held in place by surrounding stakes which are driven into the ground. Such stakes typically are installed in the ground so that their longitudinal axis is substantially vertical to horizontal, and they are typically driven into the ground with a hammer or like device for applying a downward force at one end of the stake. When stakes, large spikes, or similar objects are hammered into the ground or into other objects in this fashion, removal of the stakes can be a laborious task, especially when numerous stakes or spikes, etc. are involved. While devices are known which are configured to assist the laborer with the removal of such stakes, spikes, nails, etc., those devices are typically deficient in that they still require substantial physical force to be applied by the user, or they require heavy equipment to accompany the device or to serve as a component thereof to achieve the force necessary to facilitate removal of the elongate objects.

Thus, a need exists for a device which is configured to be hand-held and thus conveniently handled and transported, and which does not depend upon the user to supply substantial pulling force to the elongate object which is being pulled.

SUMMARY OF THE INVENTION

The present invention is deemed to fulfill this need in a highly efficient way by providing, among other things, a device which comprises: (a) at least one receiving means for receiving a free end portion of an elongate first object, the elongate first object being comprised of (i) the free end portion and (ii) an embedded end portion which is embedded in a second object, (b) at least one clamping means connected to or integral with the receiving means for applying at least one clamping force to the free end portion of the elongate first object, and (c) at least one jack which comprises a cylinder, a piston, a piston rod, and a base, the jack being connected to the receiving means so that when (i) the elongate first object is received by the receiving means, (ii) the base is in contact with the second object and (iii) a pressurized fluid is introduced into the jack to provide a separating force, the receiving means may be urged away from the second object while the clamping means applies the clamping force to the elongate first object, the amount of clamping force applied by the clamping means being proportional to the magnitude of the separating force. It will be understood that the elongate first object referred to herein may be comprised of a stake, pin or spike, or any other similar elongate object which has a free end portion and an embedded end portion which may be embedded into a second object such as, e.g., the ground or an object placed on the ground, or a wall structure. Merely for ease of reference herein, and without limiting the scope of this invention, unless otherwise indicated herein the elongate first object will be referred to hereinafter as a "stake" and the second object will be referred to as the "ground".

With respect to embodiments of this invention, it is preferred that the receiving means comprises a first hollow shaft segment which comprises at least one side wall, the side wall defining a lower passageway so that when received by the receiving means the stake may extend through the lower passageway and into at least a portion of the space within the first hollow shaft segment. It is also preferred that the side wall define one or more apertures, and that the clamping means comprises a bar which is sized, shaped and configured to extend through at least one of the apertures so that, when the receiving means is urged away from the ground, the bar cooperates with the side wall to clamp the stake between at least a portion of the side wall and at least a portion of the bar.

In another preferred embodiment, the bar is pivotally attached to the side wall and the first hollow shaft segment is surrounded by a housing through which the jack is connected to the first hollow shaft segment, the housing being sized, shaped and configured to pivotally actuate the bar when (i) the stake is received by the receiving means, (ii) the base is in contact with the ground and (iii) the jack is actuated to supply a separating force.

In yet another preferred embodiment, the side wall defines two substantially parallel and elongate lateral apertures disposed opposite one another and a third forwardly facing aperture, the lateral apertures being disposed so that their imaginary longitudinal axis is at an angle in the range between 0 and 90 degrees from horizontal, more preferably in the range of about 20 to about 80 degrees, most preferably in the range of about 45 to about 70 degrees. In addition, the bar of this preferred embodiment has two upper arm portions and a lower arm portion, the upper arm portions each being substantially perpendicular to the lower arm portion to form the shape of a "T", and the bar is disposed within the hollow shaft segment so that each of the upper arms of the "T" bar extend through one of the lateral apertures respectively and the lower arm of the "T" bar extends through the forwardly facing aperture.

This invention also provides a method of removing a stake from the ground, the stake comprising a free end portion and an embedded end portion which is embedded in the ground, the method comprising: (a) surrounding at least a portion of the stake with a rigid material to which two pneumatic jacks are connected; (b) placing at least a portion of the pneumatic jacks in contact with the ground; (c) placing one or more clamping surfaces in contact with the stake; (d) actuating the jack to introduce a separating force between the stake and the ground while concurrently introducing a clamping force to the stake through the clamping surface, the clamping force being proportionate to the separating force.

These and other embodiments and features of the invention will become still further apparent from the ensuing description, appended claims and accompanying drawings.

BRIEF DESCRIPTION OF THE DRAWINGS

In each of the above figures, like numerals are used to refer to like or functionally like parts among the several figures.

DETAILED DESCRIPTION OF THE INVENTION

As may now be appreciated, this invention provides a highly efficient device and methods for removing elongate objects such as, e.g., stakes, from objects such as, e.g., the ground. In preferred embodiments, the device of this invention is small enough to be portable by hand so that a user may easily go from stake to stake to remove them from the ground, and yet is powerful enough to significantly reduce the amount of physical labor required to apply the necessary force for pulling the stakes from the ground.

Initially, it is to be noted that the jacks used in devices of this invention may be any type of jack which may be actuated through the introduction of a pressurized fluid, suitable examples including hydraulic jacks, pneumatic jacks, and the like. Preferably, however, the jacks are pneumatic jacks because of their lightweight characteristics and the availability and portability of air compressors in the environments in which these devices are likely to be employed.

Figure 1:
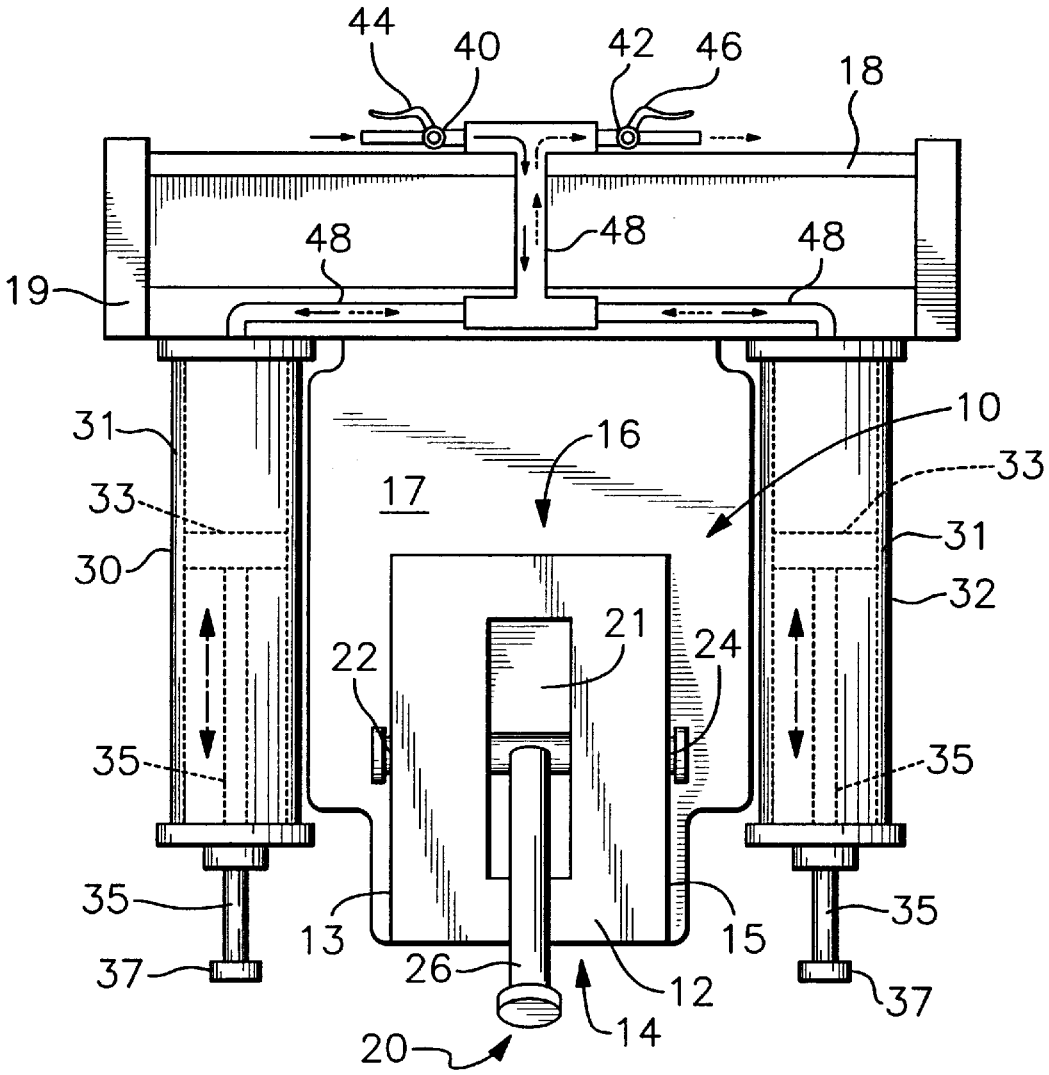
FIG. 1 is a front plan view of a preferred device of this invention.
Figure 2:
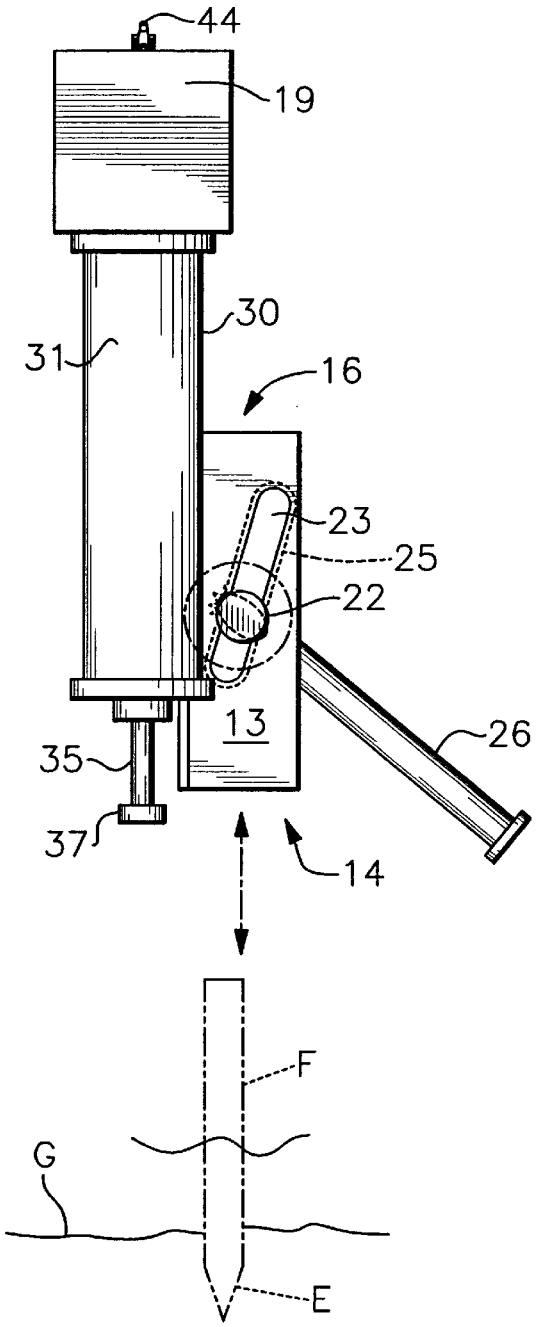
FIG. 2 is a side plan view of the device of FIG. 1.
Figure 2A:
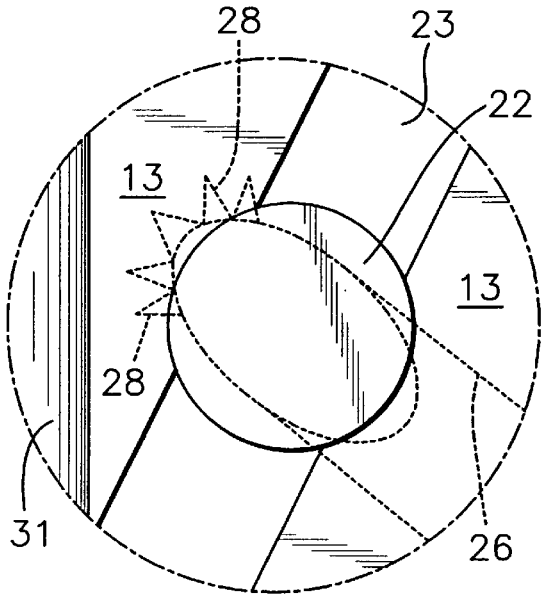
FIG. 2A is an enlarged view of the portion of the area encircled by broken line in FIG. 2.

With reference to the accompanying figures, it will be seen that FIGS. 1-8 depict at least two preferred embodiments of the present invention for pulling a stake having a free end portion F and an embedded end portion E which may be embedded in a second object such as, e.g., the ground G. The preferred embodiment depicted in FIGS. 1–2A is a device which comprises receiving means in the form of a first hollow shaft segment 10 for receiving free end portion F, clamping means in the form of a T-shaped bar 20 for applying at least one clamping force to free end portion F, and two pneumatic jacks 30 and 32. Segment 10 is comprised of a forward side wall 12, two lateral side walls 13 and 15, and a rear side wall formed by a metal plate 17. The side walls of segment 10 define a lower passageway 14 through which the stake may extend when its free end portion F is received thereby and extends into a portion of the space within first segment 10. The side walls of segment 10 further define an upper passageway 16 through which the stake may extend, if necessary, when received by segment 10 and extending through lower passageway 14 and at least a portion of the space within segment 10. Forward wall 12 defines a forwardly-facing aperture 21, and side walls 13 and 15 define, respectively, elongate lateral apertures 23 and 25. Each of lateral apertures 23 and 25 is disposed so that the imaginary longitudinal axis thereof is at an angle of approximately 65 degrees from horizontal.

T-shaped bar 20 has two upper arm portions 22 and 24, and a lower arm portion 26, upper arm portions 22 and 24 sharing a common imaginary longitudinal axis and being substantially perpendicular to lower arm portion 26. T-shaped bar 20 is disposed within segment 10 so that each of arms 22 and 24 extend respectively through one of lateral apertures 23 and 25 and lower arm portion 26 extends through forwardly-facing aperture 21. As may be seen with greater detail in FIG. 2A, a portion of the surface of upper arm portions 22 and 24 disposed within segment 10 is undulated to form a plurality of ridges 28 when viewed in cross-section taken perpendicular to the imaginary longitudinal axis shared by upper arm portions 22 and 24.

Each of jacks 30 and 32 is comprised of a cylinder 31, a piston 33, a piston rod 35, and a base 37. Each of jacks 30 and 32 is connected to first segment 10 by a handle frame 19 attached to metal plate 17. Handle frame 19 is comprised of a pneumatic pressure valve 40, a pneumatic pressure release valve 42, a handle 18, and two squeeze triggers 44 and 46 on handle 19 for controlling valves 40 and 42, respectively. The arrows on FIG. 1 indicate the flow of air through a split pneumatic line 48 which carries pressurized air to and from jacks 30 and 32. When the free end portion F is received by first segment 10 and base 37 is in contact with the ground G, jacks 30 and 32 may be actuated by introduction of pressurized air into cylinders 31,31 using trigger 44 to thereby supply a separating force which may urge first segment 10 away from the ground G while bar 20 applies a clamping force to the stake. The amount of clamping force applied by bar 20 will be proportional to the magnitude of the separating force, since gravity may urge bar 20 downwardly and toward metal plate 17 so that the stake is clamped therebetween. In other words, as bar 20, and in particular upper arm portions 22 and 24, are urged dowardly, portions 22 and 24 will contact and slide down along the edges of respective walls 13 and 15 which define angular elongate apertures 23 and 25. Ridges 28 may facilitate further the resulting clamping of the stake, especially when the stake is formed from a non-rigid material, e.g., wood or plastic, by providing a clamping surface which may act to grasp the stake and prevent slippage.

FIGS. 3–6 illustrate another preferred embodiment of this invention by showing a modified portion of the device of FIGS. 1–2A. When in use, the modified portion illustrated in FIGS. 3–6 would replace the receiving means and clamping means (segment 10 and T-shaped bar 20, respectively) shown on the device of FIGS. 1–2A. The portion depicted in FIGS. 3–6, is comprised of a cylindrical first hollow shaft segment 10*a*, a housing comprised of a second hollow shaft segment 50 which defines an opening in the form of a notch 52, and connecting means in the form of a stop bolt 54 extending into the hollow space within second segment 50 and secured there by nut 55. Segment 10*a* comprises a curved side wall 12*a* which defines a lower passageway 14*a* so that when received by the receiving means the stake may extend through the lower passageway and into at least a portion of the space within the first segment 10*a*. Side wall 12*a* further defines an upper passageway 16*a* through which the stake may extend, if necessary, when received by the receiving means and extending through the lower passageway 14a and through at least a portion of the space within the first segment 10*a*. Side wall 12*a* defines an aperture 21*a* through which bar 60 extends. Bar 60 is pivotally connected to side wall 12*a* by a pivot hinge 62 and stop 54 is disposed in substantially horizontal fashion so that at least a portion of bar 60 extends between stop 54 and the closed end of notch 52. Another bolt 56 extends through second segment 50 and is attached thereto by a corresponding bolt 57. Bolt 56 facilitates alignment of segment 10*a* within segment 50 and acts as a secondary stop to prevent segment 10*a* and bar 60 from falling out of segment 50 through passageway 14*a* during periods of use. Thus, first segment 10*a* may be moved vertically up or down, but only limited distances so that first segment 10*a* is in effect retained substantially within, or at least remains connected to, second segment 50.

Figure 3:
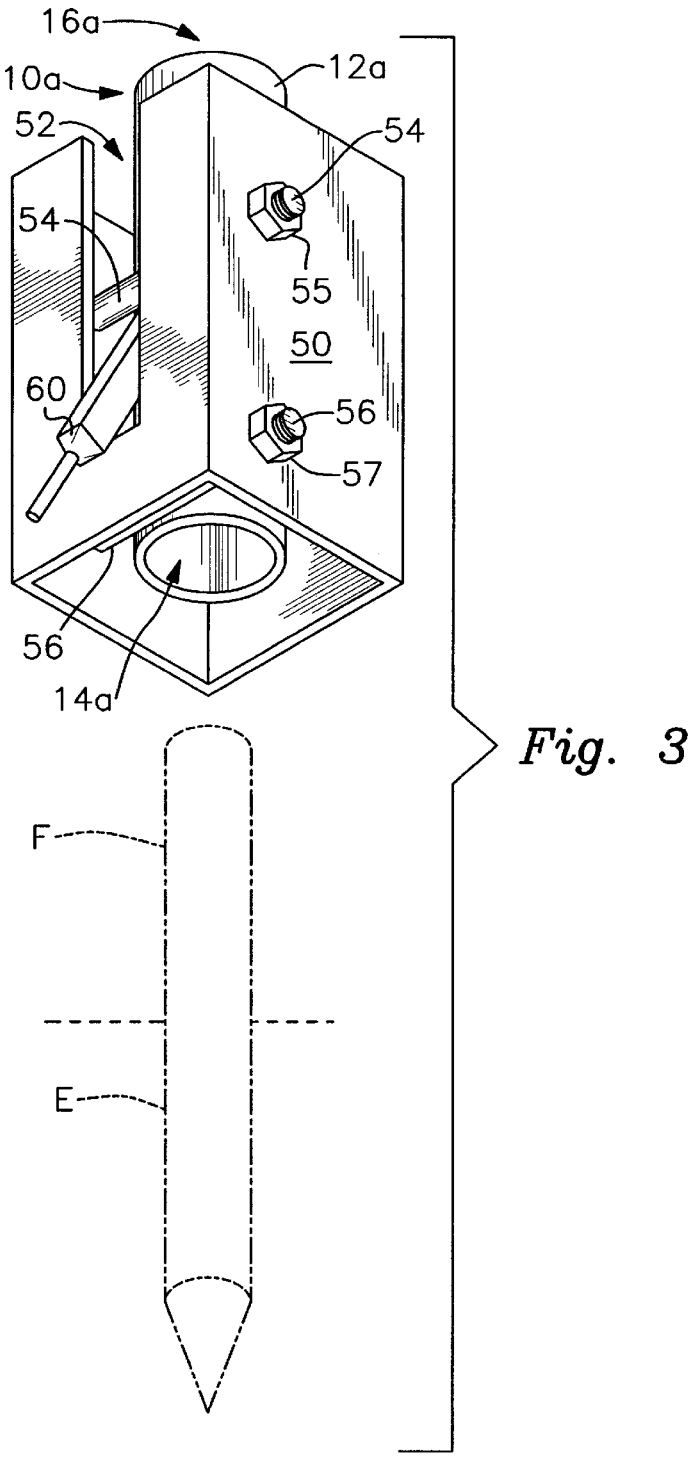
FIG. 3 is a perspective view from below of a portion of another preferred embodiment of this invention.
Figure 4:
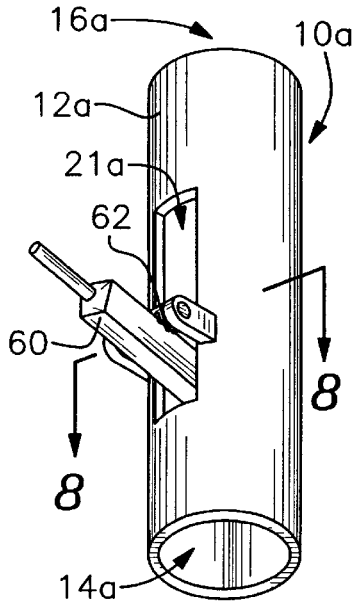
FIG. 4 is a perspective view from below of one alternative configuration of a slightly modified component of the portion depicted in FIG. 3.
Figure 4A:
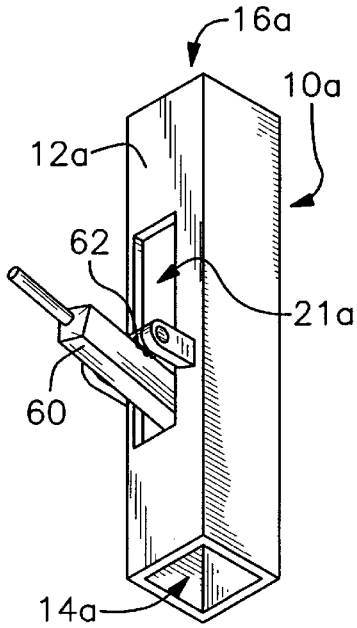
FIG. 4A is a perspective view from below of another alternative configuration for the component of FIG. 4.
Figure 8:
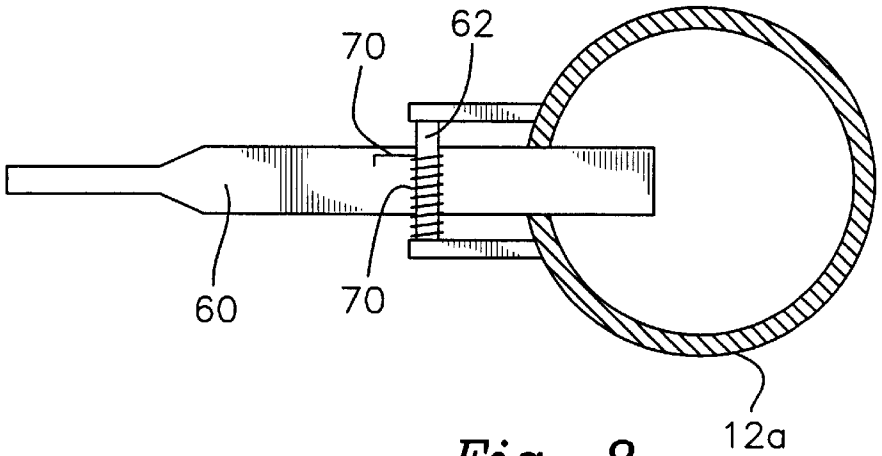
FIG. 8 is a top cross-sectional view of the component of FIG. 4 taken along line 8,8 in FIG. 4 and modified to include a biasing spring.

As FIGS. 4 and 4A illustrate, segment 10*a* does not necessarily have to be cylindrical in shape, and alternatively may be square, triangular, etc. in cross-section traverse to its longitudinal axis. A particular shape, in fact, may be more desirable than another under certain circumstances such as, for example, when it is desirable to increase the amount of first segment surface area in contact with the stake during clamping. Further, it will be understood that the shape of second segment 50 similarly may vary widely and does not constitute a limitation of this invention so long as it provides the features and advantages described herein. It will be appreciated that FIGS. 4, 4A and 8 are slightly modified versions of the portion depicted in FIGS. 3, 5 and 6 only in that pivot hinge 62 in FIGS. 4, 4A and 8 is depicted as being attached to the opposite side of bar 60 from that as depicted in FIGS. 3, 5 and 6.

Figure 5:
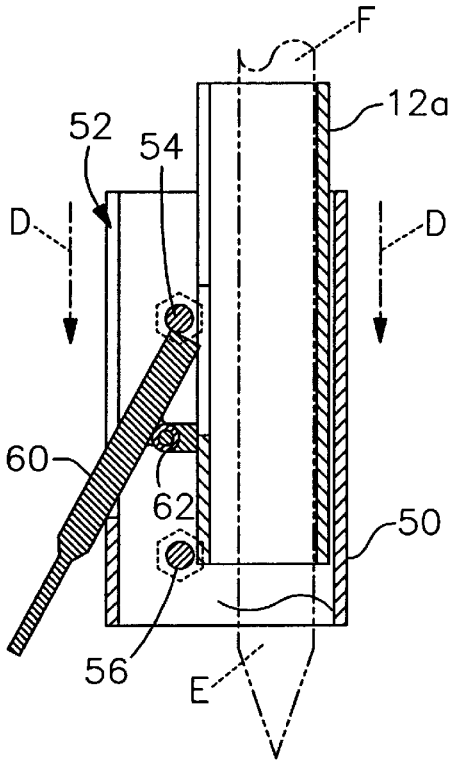
FIG. 5 is a side view in cross-section of the portion depicted in FIG. 3, illustrating, among other things, the direction in which the portion is moved to receive a stake which has been driven into the ground.
Figure 6:
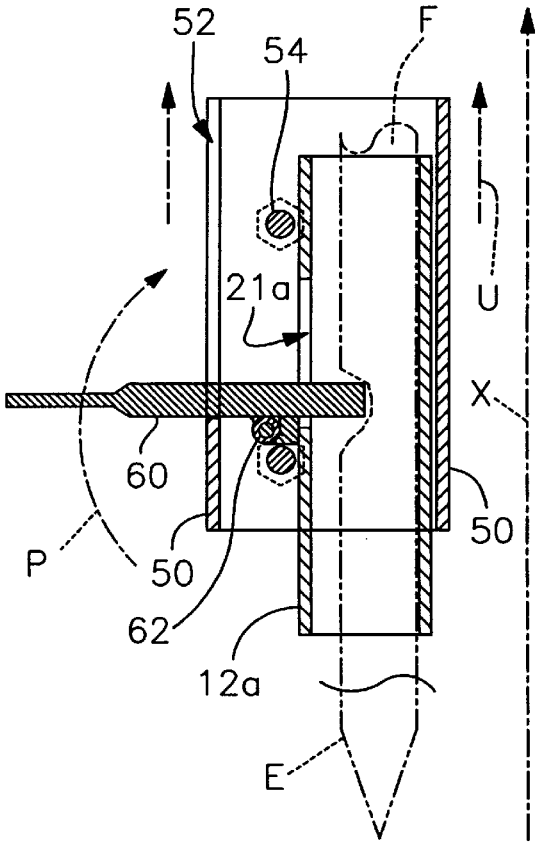
FIG. 6 is a side view in cross-section of the portion depicted in FIG. 3, illustrating, among other things, the movement which occurs when an upward force is applied in the direction indicated.

FIGS. 5 and 6 illustrate the movement of the various component parts of the portion depicted in FIG. 3 during use. The stake is received in first segment 10*a* when the device is placed above and then down around the free end portion F of the stake in the direction of arrows D,D while bar 60 is pivoted (either manually or, more preferably by gravity) into a non-clamping position as illustrated in FIG. 5. As seen on FIG. 6, once the stake is received in segment 10*a* and bases 37,37 (from FIGS. 1 and 2) are placed in contact with the ground, a separating force is applied upon activation of the jacks 30 and 32 (from FIGS. 1 and 2), and second segment 50 is thrust upwards in the direction of arrows U,U, which in turn places the closed end of notch 52 into contact with bar 60 such that bar 60 pivots in the direction of arrow P into a clamping position. As may be seen especially with reference to FIG. 6, when in this position, the clamping end of bar 60 presses into the stake, the stake is clamped between the bar and the interior surface of segment 10*a* and the separating force is transferred through second segment 50 and bar 60 into first segment 10*a*. In this way, segments 10*a* and 50, bar 60 and the clamped stake are thrust in the direction of arrow X whereupon the stake is urged out from its embedded position in the ground.

Figure 7:
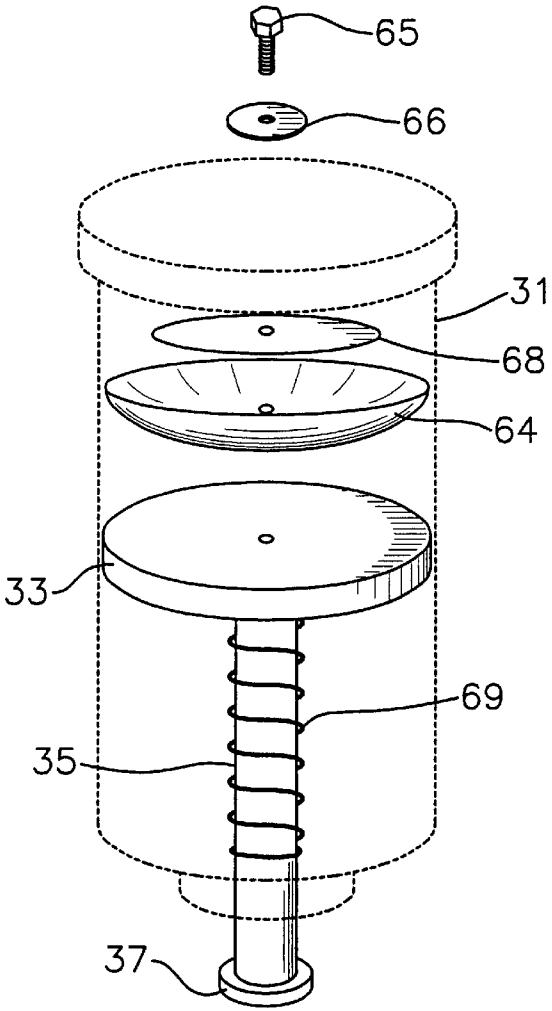
FIG. 7 is an exploded view in perspective of the moving parts of the pneumatic cylinder of a preferred embodiment of this invention.

As may be seen from FIG. 7, each of jacks 30 and 32 of the preferred embodiments depicted in the figures preferably further comprises a cup washer 64 disposed above piston 33. Washer 64 is attached to piston 33 by a bolt 65, a flat washer 66, and another larger flat washer 68. Flat washer 68 typically should be large enough in diameter to retain cup washer 64 in operative position. Preferably, cup washer 64 is made from a flexible inorganic or organic material, and most preferably, cup washer 64 is made from leather. While not required, the use of a cup washer, and especially the use of a leather cup washer, in this fashion is particularly advantageous, as it enables the device to be efficiently used repeatedly in situations where bases 37,37 are placed upon an uneven surface. In the absence of such a cup washer or its equivalent, under certain conditions the seal between the piston and the inner surface of one or more of the jack cylinders will tend to break. Under such conditions, the jack cylinders may be inclined to leak pressurized fluid during use so their operation is less than optimal.

With further reference to FIG. 7, it may be seen that the jack of the preferred embodiment depicted further comprises a compression spring 69 which is disposed within cylinder 31 and around the portion of piston rod 35 which is disposed within cylinder 31. Spring 69 serves to bias piston 33 so that the portion of rod 35 exposed to the exterior of cylinder 31 during use may be retracted rapidly back into cylinder 31 when trigger 46 is pressed to release pneumatic pressure within cylinder 31 through valve 42.

It should be appreciated that this invention may be employed not only to pull objects from substantially horizontal surfaces or objects, e.g., the ground, but may also be employed to pull objects from surfaces or objects which are substantially vertical, e.g., a wall. A preferred embodiment having this feature may be understood with reference to FIG. 8, where it may be seen that pivot hinge 62 from the portion illustrated in FIGS. 3–6 has been adapted with biasing means in the form of a spring 70 for biasing bar 60 into a clamping position. By so biasing bar 60, spring 70 enables the device to be disposed for pulling objects not only from objects or surfaces which are horizontally disposed, but also from vertically disposed surfaces or objects without adverse effect on the mechanism employed by the device to impart the separating and clamping forces necessary to pull the elongate object. While the hinge spring is particularly preferred form of biasing means, it is not the required form since the biasing means may be comprised of a wide variety of other springs, wedges, clamps, or clips, for example.

Likewise, the receiving means of this invention may comprise cylindrical hollow shafts, rings, plates, rectangular tubing, etc. capable of receiving the stake in one or more of a variety of different ways, e.g., through structure which form one or more openings which receive the stake or through structure which surrounds the stake. However, preferably the receiving means comprises a hollow shaft segment such as that depicted above.

The clamping means of this invention may take any number of forms, including but not limited to bars, concentric shafts, bolts, mechanical clamps, and the like. Preferably the clamping means comprises one of the preferred bars as depicted above. In addition, as now will be appreciated by those of ordinary skill in the art, the clamping means and the receiving means may be separate structures which are either directly or indirectly connected to one another, or they may be integral to one another so that they form portions of a single unit or structure, which portions may not be separated from one another without damage to the structure.

The connecting means of this invention may comprise a stop or a blunt protrusion from the interior surface of the housing itself, so long as it connects together the receiving means and the housing. The stop may itself comprise a bolt, bar, flange, or similar structure. However, the connecting means preferably comprises at least one, and even more preferably two, bolts extending through the housing as depicted above.

In the practice of the method of this invention for removing the stake from the ground, at least a portion of the stake may be surrounded by a rigid material (e.g., metal or hardened plastic), such as that embodied in the first hollow shaft segments described above to which pneumatic jacks 30 and 32 are attached. At least a portion of pneumatic jacks 30 and 32 are placed in contact with the ground by then lowering the device to the ground. Two clamping surfaces in the form of the clamping end of the bar and the interior surface of the first hollow shaft segment are placed in contact with the elongate first object before or concurrently with actuation of the jacks. The jacks are actuated by introduction of pneumatic pressure into the respective cylinders when the appropriate trigger is squeezed. A separating force is then produced between the stake and the ground while concurrently a clamping force is introduced to the first elongate object through the clamping surfaces, the clamping force being proportionate to the separating force since the clamping force produced by the bar will tend to increase in magnitude as the separating force increases in magnitude. With reference to the preferred embodiment depicted in FIGS. 1–2A, once the stake is removed, the lower arm portion 26 of bar 20 may be lifted to separate upper arm portions 22 and 24 from plate 17, thereby facilitating removal of the free end portion F from the receiving means of the device. Likewise, with reference to the preferred embodiment depicted in FIGS. 3–6 and 8, once the stake is removed, the free end of bar 60 opposite the clamping end of bar 60 may be moved to pivot the bar out of clamping position to facilitate removal of the free end portion F from the receiving means of the device.

This invention is susceptible to considerable variation in its practice. Therefore, the foregoing description is not intended to limit, and should not be construed as limiting, the invention to the particular exemplifications presented hereinabove. Rather, what is intended to be covered is as set forth in the ensuing claims and the equivalents thereof permitted as a matter of law. In the claims, means-plus-function clauses are intended to cover the structures described herein as performing the cited function and not only structural equivalents but also equivalent structures.

What is claimed is:

1. A device which comprises:

a) at least one receiving means for receiving a free end portion of an elongate first object, the elongate first object being comprised of (i) the free end portion and (ii) an embedded end portion which is embedded in a second object, the receiving means being comprised of a first hollow shaft segment which comprises at least one side wall, the side wall defining a lower passageway so that when received by the receiving means the elongate first object may extend through the lower passageway and through at least a portion of the space within the first hollow shaft segment, b) at least one clamping means connected to or integral with the receiving means for applying at least one clamping force to the free end portion of the elongate first object, and c) at least one jack which comprises a cylinder, a piston, a piston rod, and a base, the jack being connected to the receiving means so that when (i) the elongate first object is received by the receiving means, (ii) the base is in contact with the second object and (iii) a pressurized fluid is introduced into the jack to provide a separating force, the receiving means may be urged away from the second object while the clamping means applies the clamping force to the elongate first object, the amount of clamping force applied by the clamping means being proportional to the magnitude of the separating force, and wherein the side wall further defines an upper passageway through which the elongate first object may extend, if necessary, when received by the receiving means and extending through the lower passageway and through at least a portion of the space within the first hollow shaft segment.

2. A device according to claim 1 wherein the jack is a pneumatic jack.

3. A device according to claim 2 wherein the pneumatic jack further comprises a cup washer.

4. A device according to claim 2 further comprising at least one pneumatic pressure valve, a handle, and at least one trigger for controlling the pneumatic pressure valve.

5. A device which comprises:

a) at least one receiving means for receiving a free end portion of an elongate first object, the elongate first object being comprised of (i) the free end portion and (ii) an embedded end portion which is embedded in a second object, the receiving means being comprised of a first hollow shaft segment which comprises at least one side wall, the side wall defining a lower passageway so that when received by the receiving means the elongate first object may extend through the lower passageway and through at least a portion of the space within the first hollow shaft segment, the side wall further defining one or more apertures, b) at least one clamping means connected to or integral with the receiving means for applying at least one clamping force to the free end portion of the elongate first object, and c) at least one jack which comprises a cylinder, a piston, a piston rod, and a base, the jack being connected to the receiving means so that when (i) the elongate first object is received by the receiving means, (ii) the base is in contact with the second object and (iii) a pressurized fluid is introduced into the jack to provide a separating force, the receiving means may be urged away from the second object while the clamping means applies the clamping force to the elongate first object, the amount of clamping force applied by the clamping means being proportional to the magnitude of the separating force, and wherein the clamping means comprises a bar which is sized, shaped and configured to extend through at least one of the apertures so that, when the receiving means is urged away from the second object, the bar cooperates with the side wall to clamp the elongate first object between at least a portion of the side wall and at least a portion of the bar.

6. A device according to claim 5 wherein the bar is pivotally attached to the side wall and the first hollow shaft segment is surrounded by a housing through which the jack is connected to the first hollow shaft segment, the housing being sized, shaped and configured to pivotally actuate the bar when (i) the elongate first object is received by the receiving means, (ii) the base is in contact with the second object and (iii) the jack is actuated to supply a separating force.

7. A device according to claim 6 wherein the jack is a pneumatic jack.

8. A device according to claim 7 wherein the pneumatic jack further comprises a cup washer.

9. A device according to claim 7 further comprising at least one pneumatic pressure valve, a handle, and at least one trigger for controlling the pneumatic pressure valve.

10. A device according to claim 6 wherein the housing is comprised of a second hollow shaft segment defining an opening through which the bar may extend, and connecting means, within the hollow space formed by the second hollow shaft segment, for connecting the second hollow shaft segment to the first hollow shaft segment, whereby the first hollow shaft segment may be retained within the second hollow shaft segment and the bar may be pivotally actuated to thereby clamp the elongate first object when (i) the elongate first object is received by the receiving means, (ii) the base is in contact with the second object, and (iii) the jack is actuated to supply a separating force.

11. A device according to claim 10 wherein the opening is in the form of a notch, and the connecting means comprises at least one stop extending into the hollow space within the second hollow shaft segment, the stop being disposed in substantially horizontal fashion so that at least a portion of the bar extends between the stop and the closed end of the notch, whereby the first hollow shaft segment may be retained within the second hollow shaft segment.

12. A device according to claim 6 further comprising biasing means for biasing the bar to pivot into a clamping position.

13. A device according to claim 10 wherein the biasing means comprises a spring.

14. A device according to claim 5 wherein the side wall defines two substantially parallel and elongate lateral apertures disposed opposite one another and a third forwardly facing aperture, each of the lateral apertures being disposed so that each of their respective imaginary longitudinal axes is at an angle in the range between 0 and 90 degrees from horizontal; wherein the bar has two upper arm portions and a lower arm portion, the upper arm portions each being substantially perpendicular to the lower arm portion to form the shape of a "T"; and wherein the bar is disposed within the hollow shaft segment so that each of the upper arms of the bar extend through one of the lateral apertures respectively and the lower arm of the bar extends through the forwardly facing aperture.

15. A device according to claim 14 wherein at least a portion of the surface formed by the portion of the upper arm portions disposed within the hollow shaft segment is undulated when viewed in cross-section taken perpendicular to the longitudinal axis of the upper arm portions.

16. A device according to claim 14 wherein the jack is a pneumatic jack.

17. A device according to claim 16 wherein the pneumatic jack further comprises a cup washer.

18. A device according to claim 16 further comprising at least one pneumatic pressure valve, a handle, and at least one trigger for controlling the pneumatic pressure valve.

19. A device according to claim 5 further comprising biasing means for biasing the bar into a clamping position.

20. A device according to claim 19 wherein the biasing means comprises a spring.

* * * * *